United States Patent [19]

Benezra et al.

[11] 4,055,476

[45] Oct. 25, 1977

[54] METHOD FOR LOWERING CHLORATE CONTENT OF ALKALI METAL HYDROXIDES

[75] Inventors: Leo L. Benezra, Mentor; David W. Hill; Arnold Riihimaki, both of Painesville; Shan-Pu Tsai, Mentor, all of Ohio

[73] Assignee: Diamond Shamrock Corporation, Cleveland, Ohio

[21] Appl. No.: 760,910

[22] Filed: Jan. 21, 1977

[51] Int. Cl.[2] ..... C25B 1/16; C25B 1/26

[52] U.S. Cl. ..... 204/98; 204/128

[58] Field of Search ..... 204/98, 128

[56] References Cited

U.S. PATENT DOCUMENTS

| | | | |
|---|---|---|---|
| 2,823,177 | 2/1958 | Osborne | 204/98 |
| 3,793,163 | 2/1974 | Dotson | 204/98 |

*Primary Examiner*—R. L. Andrews

*Attorney, Agent, or Firm*—John P. Hazzard

[57] ABSTRACT

A method of minimizing chlorate formation when brines are decomposed in diaphragm type electrolytic cells which comprises adding brine containing dissolved nickel values periodically to said cell while continuing operation of the cell. The nickel values can be added whenever the chlorate content of the alkali metal hydroxide increases to again minimize chlorate formation.

6 Claims, 1 Drawing Figure

METHOD FOR LOWERING CHLORATE CONTENT OF ALKALI METAL HYDROXIDES

BACKGROUND OF THE INVENTION

In the electrolytic cells of the diaphragm type, such as the type of cell described in U.S. Pat. No. 1,866,065, the anode compartment is separated from the cathode compartment by a permeable diaphragm. Alkali metal chloride brine, such as lithium, sodium, or potassium chloride, is introduced into the anode compartment, where it comes into contact with the anodes, and is caused to percolate through the diaphragm into the cathode compartment, where it comes into contact with the cathodes. When an electric current is passed between these electrodes, chlorine is liberated at the anodes and alkali metal hydroxide is formed at the cathodes with the liberation of hydrogen. In order to minimize voltage drop in the cell, the cathodes are placed as close to the diaphragm as possible; and in fact, in practice the diaphragm is generally a thin sheet of fibrous material, preferably of asbestos, overlying and supported by cathodes of woven iron wire screen. The cathode compartment may be occupied by hydrogen; but in best modern practice it is allowed to fill up with caustic alkali solution to a level at which the diaphragm is largely submerged, and to overflow from the cell at that level. In any case, the surface of the cathodes in contact with the diaphragm is wet with catholyte.

A review of the electrochemistry of deposited diaphragm type cells has been given by Murray, R. L. and Kircher, M. S. in the Transactions of the Electrochemical Society; vol. 86, pp. 83–106; 1944.

Chlorine, as such and as hypochlorous acid, is more or less soluble in brine, even at elevated temperatures, and forms hypochlorites n accordance with the following representative equations $$H_2O + Cl_2 \rightarrow H^+ + Cl^- + HClO \quad (1)$$

$$HClO \rightarrow H^+ + ClO^- \quad (2)$$

$$ClO^- + Na^+ \rightarrow NaClO \quad (3)$$

Thus, some chlorine inevitably passes through the diaphragm in solution in the percolating brine. When coming into contact with the caustic alkali in the cathode compartment, this chlorine reacts with the alkali to form alkali metal hypochlorite, in accordance with the following representative equations $$Na^+ + 2OH^- + Cl_2 \rightarrow NaClO + Cl^- + H_2O \quad (4)$$

$$Na^+ + OH^- + HClO \rightarrow NaClO + H_2O \quad (5)$$

and, more likely, the hypochlorite is completely ionized;

$$Na^+ + OH^- + HClO \rightarrow Na^+ + ClO^- + H_2O$$

This, of course, represents a loss of both chlorine and caustic alkali as useful product; hence a loss in current efficiency.

A more serious loss comes about through back migration from the cathode compartment of the cell, or face of the cathode itself, through the diaphragm to the anode compartment, chiefly of negatively charged hydroxyl ions seeking their way to the positive anode. Hydroxyl ions reaching the anodes as such are then discharged, liberating oxygen. However, at normal anolyte pH, which is about 4, hypochlorous acid may be formed by reaction with the chlorine in accordance with the following equation $$OH^- + Cl_2 \rightarrow HClO + Cl^- \quad (6)$$

Furthermore, since the hydroxyl ions carry a negative charge, which is discharged at the anode, their back migration represents a loss in current efficiency.

Hypochlorite ion, which is formed from the hydrolysis of chlorine dissolved in the anolyte, is discharged at the anode to form chlorate ion in a manner after the following equation $$12ClO^- + 6H_2O \rightarrow 4ClO_3^- + 8Cl^- + 12H^+ + 3O_2 + 12e \quad (7)$$

Further, hypochlorous acid and hypochlorite ion are unstable under the conditions of electrolysis and tend to form chlorate ion and oxygen according to the following equations $$ClO^- + 2HClO \rightarrow ClO_3^- + 2Cl^- + 2H^+ \quad (8)$$

$$2HClO \rightarrow O_2 + 2Cl^- + 2H^+ \quad (9)$$

The oxygen produced from hydroxyl ions discharging at the anode and from the decomposition of some of the hypochlorites in the anolyte thereby results in contamination of the chlorine; also, since the anodes are of graphite, some of the oxygen attacks the anodes, slowly consuming them, which results in the contamination of the chlorine with carbon dioxide. Similarly, the oxygen produced from the decomposition of some of the hypochlorites in the catholyte results in contamination of the hydrogen with oxygen.

In the cathode compartment substantial amounts of the hypochlorite and chlorate ions are reduced by nascent hydrogen ($H^0$) formed at the cathode according to the following equations $$2H^0 + ClO^- \rightarrow Cl^- + H_2O \quad (10)$$

$$6H^0 + ClO_3^- \rightarrow Cl^- + 3H_2O \quad (11)$$

However, some of the hypochlorite and chlorate ions escape reduction in the catholyte and pass out of the cell and thereby contaminate the cell effluent which is mainly spent brine having the alkali metal hydroxide dissolved therein.

In the presence of an excess of alkali, the chlorate is quite stable. It therefore tends to persist in the cell effluent and to pass on through to the evaporators in which the caustic alkali is concentrated. Practically all of the chlorate survives the evaporation and remains in the final product, where it constitutes a highly objectionable contaminant, especially to the Rayon industry.

The problem of lowering chlorates has been attacked at two main points a. The chlorates having been formed, can be reduced in the further processing of the caustic alkali and by special treating methods. See for instance, U.S. Pat. Nos. 2,622,009; 2,044,888; 2,142,670; 2,207,595; 2,258,545; 2,403,789; 2,415,798; 2,446,868; and 2,562,169; and British Pat. Nos. 642,946 and 664,023 which show representative examples of different methods used for reducing the chlorates after they have been formed.

b. The production of chlorates during the electrolysis can be lowered by adding a reagent to the brine feed which reacts preferentially with the back migrating hydroxyl ions from the cathode compartment of the cell making their way through the diaphragm into the anode compartment, and by such a reaction prevents the formation of some of the hypochlorites in the manner shown by Equation 6 and thus additionally preventing these hypochlorites from further reacting to form chlorates in the manner shown by Equations 7, 8, and 9. Reagents such as hydrochloric acid shown in U.S. Pat. No. 583,330, and sulfur in an oxidizable form, such as sodium tetrasulfide, shown in U.S. Pat. No. 2,569,329 are illustrative of methods which have been used to attack the problem of chlorates in caustic by removing the back migrating hydroxyl ions before they can react to form chlorates.

Another method of controlling chlorate in alkali metal hydroxides in U.S. Pat. No. 2,823,177. In this patent, nickel or cobalt metal or salts thereof in finely divided form are incorporated into a cell diaphragm when it is being constructed outside of the cell in which it is to be utilized. This nickel or cobalt in the diaphragm is believed to be converted to the insoluble hydroxide form in the diaphragm which then acts catalytically to reduce chlorate formation in an operating electrolytic cell by decomposing the precursor hypochlorite before it can converted to chlorate. This process disclosed in U.S. Pat. No. 2,823,177 is effective for a period of time less than the period of time the diaphragm itself is useful in the electrolysis and thus the operation of the cell must be stopped and the diaphragm replaced if low chlorate alkali metal hydroxide is to be obtained. The length of life for a diaphragm of the type disclosed in U.S. Pat. No. 2,823,177 depends on the degree of nickel loading in the diaphragm, the form of the nickel or cobalt as well as the production rate of the cell and the life can be prematurely ended by poisoning of the nickel or cobalt hydroxide catalyst during upsets to the system. In commercial operation, cells employing such nickel or cobalt containing diaphragms have been found to be fully operational from one to two months before they must be replaced with the accompanying shutdown.

The invention of the present application on the otherhand utilizes only nickel values in the brine feed periodically to continuously maintain minimal chlorate formation thus eliminating excessive chlorate formation as a life determining factor in operation of such an electrolytic cell. Likewise, the present method of minimizing chlorate production is less critical in that the nickel values are supplied more evenly to the diaphragm since the nickel is dissolved in the brine feed whereas the closest prior art patent attempts to obtain uniformity by mixing finely divided nickel solids with the material of the diaphragm during construction thereof. The use of solid particulate nickel values by the prior art method of necessity results in the use of excess nickel as compared to the use of dissolved nickel values in accordance with the instant invention.

BRIEF SUMMARY OF THE INVENTION

The present method of minimizing chlorate formation during the electrolysis of alkali metal halide brines in diaphragm type electrolysis cells utilizes periodic additions of nickel values to the cell. The addition is made preferably with the incoming brine which would have the nickel values dissolved therein and uniformly distributed throughout said brine. The nickel values in solution in the brine are believed to react with back migrating hydroxyl ions forming a relatively uniform coating on or dispersion in the diaphragm of nickel hydroxide which inturn is believed to prevent chlorate formation by catalytically decomposing hypochlorite which is the precursor to chlorates. The nickel hydroxide catalyst is thereafter effective in minimizing chlorate production until it is poisoned, consumed or the like. The exact reason the nickel values become ineffective after a period of time is unknown but it is certain to occur. The higher the loading of nickel, the longer is the effective period within reason. In the practice of the instant invention the chlorate minimization is rejuvenated by again adding brine containing dissolved nickel values during continued operation of the cell.

DESCRIPTION OF THE PREFERRED EMBODIMENTS

Figure 1:
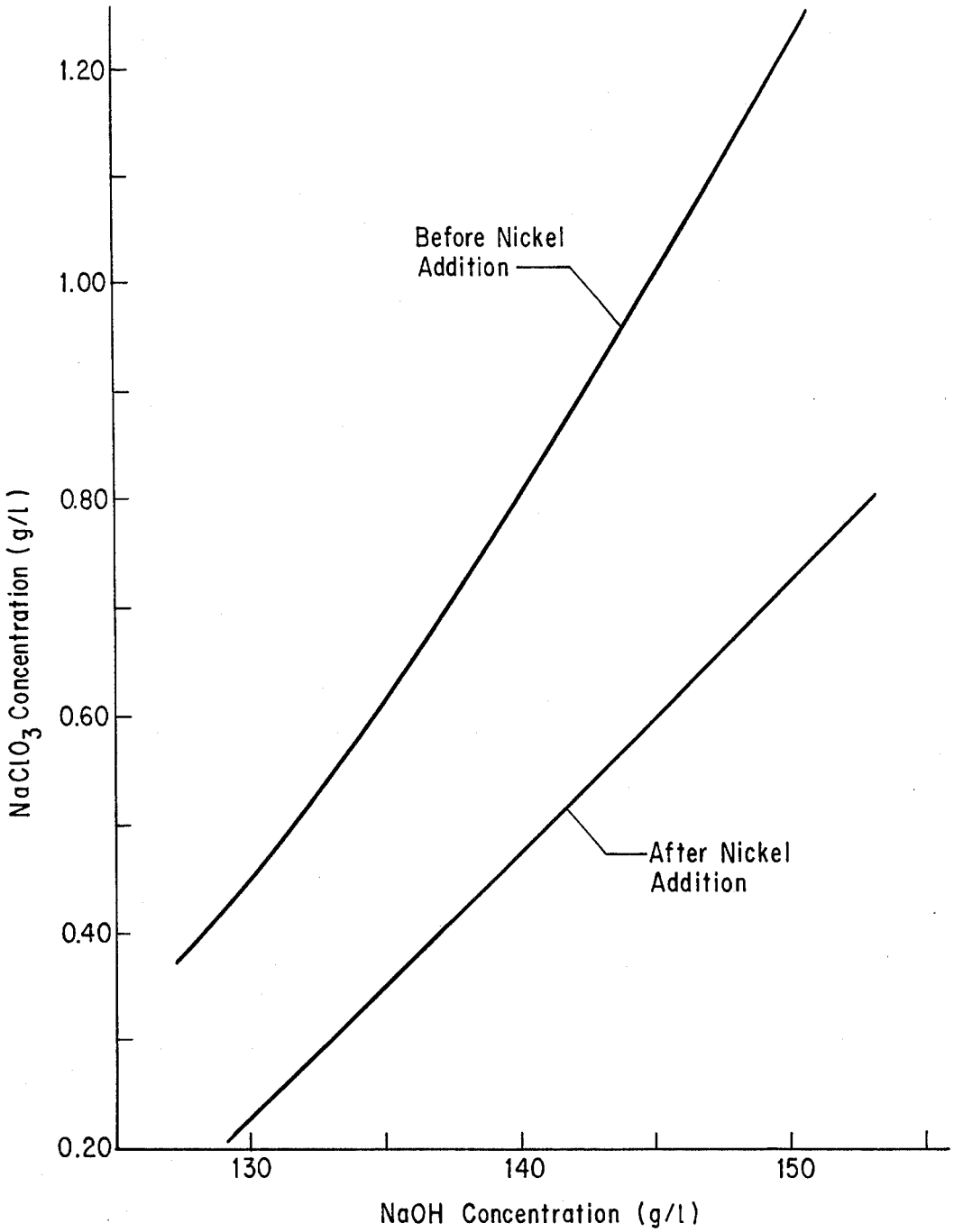
FIG. 1 of the drawings illustrates typical chlorate concentrations in caustic produced by a given test cell with and without the addition of nickel values at varying caustic concentrations.

The present invention for the sake of clarity will be described as a method for electrolysing sodium chloride brines in diaphragm-type cells although the same is equally applicable to the other alkali metal halides.

In the electrolysis of sodium chloride brines in diaphragm type cells, the brine is introduced into the anode compartment, where it comes in contact with the anodes and is caused to percolate through the diaphragm into the cathode compartment and into contact with the cathodes. Thus, when an electric current is passed between these electrodes, chlorine is liberated at the anodes and sodium hydroxide is formed at the cathodes with the liberation of hydrogen. In order to minimize voltage drop in the cell, the cathodes are placed as close to the diaphragm as possible, and in fact, in practice the diaphragm is generally a thin sheet of fibrous material, preferably of asbestos, overlying and supported by cathodes of woven iron wire screens. The exact makeup of the diaphragm is not critical in the present invention and thus other known organic or inorganic fibrous materials can be used in replace of or in partial replacement of the standard asbestos.

Preferably, at initial startup of such a cell, the feed brine has dissolved therein a small amount of nickel values. However, the nickel can be added at anytime after initial startup to affect the stated chlorate reduction. It is believed that the dissolved nickel values in the brine feed react with hydroxyl ions migrating back through the diaphragm from the cathode to form insoluble colloidal nickel hydroxide on the surface of or in the membrane. This fine precipitate of nickel hydroxide on or in the membrane is believed to act catalytically to minimize chlorate formation. The reaction mechanism through which it is believed to act is the catalytic decomposition of hypochlorites which are produced in a side reaction in the electrolytic cell before such hypochlorites are oxidized to chlorates. This inclusion of small amounts of dissolved nickel values in the feed brine can be continuous or periodic. The preferred method is the periodic addition of dissolved nickel values to the incoming brine and said additions being made when the chlorate concentration in the caustic produced exceeds the desired minimum. Between such nickel additions the cell is operated on its standard brine feed. The periodic addition of nickel to the brine feed is preferred only because the very minimal amount of nickel needed to effect the desired result is almost impossible to economically effect in a continuous feed and thus would result in a waste of nickel in the process.

In theory, the amount of nickel required in an initial treatment is such that a highly uniform coating or dispersion of nickel hydroxide be formed on or in the diaphragm and such is dependent solely on the surface area of the diaphragm. Theoretically, addition of but a few grams of nickel is sufficient even for commercial units, but, preferably, an addition of 10 to 50 mg/sq. in. would be made to assure proper dispersion in the brine and onto the diaphragm. Excess nickel addition is governed only by the nickel concentration allowable in the caustic product.

Also it is preferred to use a low concentration of nickel in the brine feed during such treatments. Although it is not critical, the nickel values are best added in diluted form so as to more easily effect a uniform concentration in the brine feed. Uniformity of concentration is in fact more important than a low or high concentration when attempting to apply a uniform precipitate of nickel hydroxide on or in the diaphragm.

Any nickel compound or metal may be used in the practice of the instant invention provided the aspect of uniformity of concentration is kept in mind. If nickel metal is used, it must be dissolved and thoroughly mixed with the brine before reaching the diaphragm. In nearly all cases, the nickel should be dissolved and thoroughly mixed with the brine prior to entry of the brine into the cell. In the case of the more soluble nickel salts such as nickel chloride the dissolution of same and mixing with the brine might occur within the cell if there is sufficient turbulence therein but preferably this nickel source would be dissolved and mixed with the brine prior to entry into said cell. Nickel chloride and nickel sulfate are the preferred sources of nickel values.

After the initial nickel treatment, the electrolytic cell is run on standard brine and the caustic produced is monitored for chlorate content. When the chlorate level rises to some predetermined level the nickel treatment is repeated. This is done over and over again thus eliminating intolerable chlorate levels as a life determining factor in such cells. These subsequent nickel treatments need not be as extensive as the initial treatment since there is usually some active nickel remaining in the diaphragm. Thus, by the practice of the instant invention a chloralkali cell of the diaphragm type can be maintained in continuous production while performing the treatments to minimize chlorate formation whereas the closest prior art process requires stopping the operation of the cell and replacement of the diaphragm with subsequent loss of production.

Typically, the nickel treatment of the instant invention seems to decrease the amount of chlorate produced by half for a given set of operating conditions in a given cell at a given caustic concentration. FIG. 1 of the drawings is illustrative of this interrelationship for the cell of Example 1.

The following example is illustrative of the instant invention. Other cells of varying diaphragm sizes, and varying nickel addition rates have been run with similar results.

EXAMPLE. 1

A typical test cell of the diaphragm type was used in this example. It included a 25 square inch cathode of woven iron screen having an asbestos diaphragm overlying said cathode. The anolyte was maintained at approximately 310 grams per liter NaCl and the cell temperature was maintained at 200° F. throughout the tests. The cell was then continuously operated both with and without nickel additions to the brine feed and chlorate and caustic concentrations were recorded during the runs both with and without nickel additions to the brine feed. FIG. 1 of the drawings illustrates a summary of the data in graphic form wherein the nickel addition consisted of dissolving, mixing and adding with the brine feed 725 mg of $NiCl_2.6H_2O$ ( equivalent to ~7.2 mg Ni/sq. in. of diaphragm surface area). During this runs, the average time between required nickel additions to keep chlorate formation suppressed was about 22 days.

Other test runs indicate that the rate and frequency vary greatly among various cells and operating conditions. But, based on the numerous runs, it appears that the preferred nickel addition or treatment per unit area of diaphragm is in the range of 4 to 10 milligrams nickel per square inch of diaphragm although lower or higher amounts could be used. If lower amounts are used, the treatments are, of necessity, more frequent and require closer monitoring. Treatments with nickel in accordance with the instant invention should ideally be such that the time between treatments is between 15 and 30 days. If higher than the preferred amount of nickel per treatment is used, the depression of chlorate level will still result to the same extent but the time between treatments will not increase linearly with respect to the extra weight of nickel used in the treatment. In fact, if the treatment is excessive, the passages through the porous diaphragm could become restricted.

When performing the nickel addition, the nickel values should be dissolved in and mixed with at least an amount of brine equivalent to the brine required to fill the cell. Preferably, two to ten such volumes of brine should carry the nickel to the cell. Higher dilution is not detrimental and can be used if desired, however, use of less than one cell volume of brine could result in less than uniform contact or coverage of the diaphragm with equivalent quantities of nickel values.

We claim:

1. An improved method of minimizing chlorate contamination of alkali metal hydroxides made by electrolysis of alkali metal halide solution in an electrolytic cell wherein the anode compartment is separated from the cathode compartment by a porous, liquid permeable diaphragm, said improvement comprising periodically adding dissolved nickel values to the brine feed of said electrolytic cell and precipitating said nickel values on and in the porous, liquid permeable diaphragm.

2. The method of claim 1 wherein said nickel values are added to the alkali metal halide feed in the form of soluble nickel chloride.

3. In a method for decomposing sodium chloride brine in electrolytic alkali chlorine cells of the diaphragm type, the improvement which comprises: periodically adding nickel values to the brine feed of said electrolytic cell so that the brine with nickel values dissolved therein comes in contact with the cell diaphragm and reacts with hydroxyl ions to form or maintain a uniform dispersion of catalytically active nickel hydroxide on said porous, liquid permeable diaphragm so as to minimize chlorate formation.

4. The method of claim 3 wherein said nickel values are added to the brine feed in the form of soluble nickel chloride.

5. In a method for decomposing brine in electrolytic alkali halide cells of the diaphragm type so as to minimize chlorate formation, the improvement comprising periodically feeding brine to the cell containing dissolved nickel values, monitoring the chlorate content of the alkali metal hydroxide exiting said cell and, upon a rise in chlorate content in said alkali metal hydroxide, repeating the feeding of brine containing dissolved nickel values to said cell to again suppress chlorate formation while continuously operating said cell.

6. The method of claim 5 wherein said brine is a sodium chloride and the nickel values in the brine are in the form of dissolved nickel chloride.

* * * * *